US009765520B2

(12) United States Patent
Armbrust et al.

(10) Patent No.: US 9,765,520 B2
(45) Date of Patent: Sep. 19, 2017

(54) TUBULAR JOIST STRUCTURES AND ASSEMBLIES AND METHODS OF USING

(71) Applicants: Scott F. Armbrust, Edmond, OK (US); Scott A. Armbrust, Edmond, OK (US)

(72) Inventors: Scott F. Armbrust, Edmond, OK (US); Scott A. Armbrust, Edmond, OK (US)

( * ) Notice: Subject to any disclaimer, the term of this patent is extended or adjusted under 35 U.S.C. 154(b) by 0 days.

(21) Appl. No.: 14/214,595

(22) Filed: Mar. 14, 2014

(65) Prior Publication Data

US 2014/0338279 A1 Nov. 20, 2014

Related U.S. Application Data

(60) Provisional application No. 61/784,615, filed on Mar. 14, 2013.

(51) Int. Cl.

| | |
|---|---|
| ***E04C 3/04*** | (2006.01) |
| ***E04B 1/24*** | (2006.01) |
| ***E04C 3/08*** | (2006.01) |
| *E04B 5/10* | (2006.01) |
| *E04B 7/02* | (2006.01) |
| *E04C 3/02* | (2006.01) |

(52) U.S. Cl.

CPC ..... *E04C 3/08* (2013.01); *E04B 5/10* (2013.01); *E04B 7/022* (2013.01); *E04C 2003/026* (2013.01); *E04C 2003/0439* (2013.01); *E04C 2003/0491* (2013.01)

(58) Field of Classification Search

CPC ..... E04C 3/02; E04C 3/04; E04C 3/08; E04C 2003/0486; E04C 2003/0491; E04C 2003/0465; E04B 5/10; E04B 7/22

USPC ..... 52/653.2, 650.2, 690, 693

See application file for complete search history.

(56) References Cited

U.S. PATENT DOCUMENTS 1,924,880 A * 8/1933 Ragsdale ..... 52/650.2
2,514,607 A * 7/1950 McLean ..... 52/692

(Continued)

FOREIGN PATENT DOCUMENTS

JP 09125521 A * 5/1997 ..... E04B 1/342

OTHER PUBLICATIONS

OSHA 29 CFR 1926.751 https://www.osha.gov/pls/oshaweb/owadisp.show_document?p_table=STANDARDS&p_id=10787.*

*Primary Examiner* — Christine T Cajilig

(57) ABSTRACT

A hollow tubular joist structure, a joist assembly including a plurality of aligned repetitive tubular joist structures, and a method of constructing this joist assembly. The tubular joist structure may include any suitable cross-sectional geometry. The joist structure includes a tubular top chord; a tubular bottom chord; and, a plurality of diagonals extending between the tubular top chord and the tubular bottom chord. The diagonals may also be tubular. The diagonals are arranged in a zig-zag formation between the tubular top chord and the tubular bottom chord. The tubular top chord may be capable of receiving a power actuated fastener (PAF). The tubular top chord or the tubular bottom chord may also be capable of receiving a utility conduit. A method of constructing a joist assembly of the present disclosure includes assembling a plurality of joist structures each including a top chord, a bottom chord, and a plurality of diagonals extending between the top chord and bottom chord; and, wherein a plurality of the joist structures include a tubular top chord and a tubular bottom chord.

19 Claims, 7 Drawing Sheets

(56) References Cited

U.S. PATENT DOCUMENTS 3,019,861 A * 2/1962 Rasch ..... E04B 1/342 52/262
3,058,549 A * 10/1962 Anderson ..... E04B 1/342 52/127.1
3,131,791 A * 5/1964 Nichols et al. ..... 52/364
3,314,209 A * 4/1967 Troutner ..... E04C 3/07 52/639
3,708,928 A * 1/1973 Gaspers ..... E04B 1/24 52/641
3,785,109 A * 1/1974 Letourneur ..... 52/633
3,826,057 A * 7/1974 Franklin ..... 52/641
4,253,210 A * 3/1981 Racicot ..... 52/694
4,543,008 A * 9/1985 Salama ..... E04B 1/585 138/108
4,912,903 A * 4/1990 Mogami et al. ..... 52/653.2
5,435,110 A * 7/1995 Stol ..... B62D 23/005 403/170
5,437,135 A * 8/1995 Witte ..... 52/693
5,761,873 A * 6/1998 Slater ..... E04B 1/08 52/633
5,794,398 A * 8/1998 Kaehler et al. ..... 52/653.2
5,802,772 A * 9/1998 Burke et al. ..... 52/6
6,205,736 B1 * 3/2001 Amborn ..... B21C 37/294 296/203.01
6,237,299 B1 * 5/2001 Gortan ..... 52/693
6,993,880 B2 * 2/2006 Cameron et al. ..... 52/653.2
8,627,633 B2 * 1/2014 Davies ..... 52/653.2
8,800,238 B2 * 8/2014 Davies ..... 52/653.2
8,851,096 B2 * 10/2014 De Villenfagne De Sorinnes et al. ..... 135/122
8,910,447 B2 * 12/2014 Wallther ..... 52/655.1
8,978,338 B2 * 3/2015 Jobin et al. ..... 52/653.2
2004/0003550 A1 * 1/2004 Konopka ..... E04B 1/74 52/169.6
2006/0101646 A1 * 5/2006 Jhang ..... 29/897.31
2008/0196320 A1 * 8/2008 Weinberg ..... E04B 7/02 52/23
2009/0019811 A1 * 1/2009 Goldman ..... E04B 1/3483 52/653.2
2010/0043329 A1 * 2/2010 Dagg ..... E04B 1/24 52/414
2010/0326003 A1 * 12/2010 Davies ..... 52/641
2013/0291477 A1 * 11/2013 Jobin et al. ..... 52/653.2

* cited by examiner

TUBULAR JOIST STRUCTURES AND ASSEMBLIES AND METHODS OF USING

CROSS REFERENCE TO RELATED APPLICATION

This application claims the benefit of U.S. Provisional Application No. 61/784,615 filed Mar. 14, 2013, herein incorporated by reference in its entirety for all purposes.

FIELD OF THE INVENTION

The present invention relates, generally, to materials used in construction. More specifically, the present invention relates to steel joist structures used in building construction.

BACKGROUND OF THE INVENTION

Steel joists have been used to structurally support building roofs and floors throughout the United States for the better part of a century. An exemplary array of conventional joists forming a support for a deck or roof is depicted in FIG. 1. The term "joist", as used herein, indicates a closely spaced, repetitive member that directly supports (and in combination directly supports) a relatively flat structural element such as a roof deck or floor slab or the like. A steel joist, as opposed to a common truss, is defined by the U.S. Department of Labor in OSHA 29 C.F.R. §1926.751, incorporated fully herein by reference. Joists of identical properties are commonly found in a building in relatively large numbers, and as a result, such joists are currently manufactured in mass quantities. In contrast to the joist, a "girder" is a relatively heavier member that are fewer in number and that directly supports the joists.

The conventional steel joist used today consists of a top chord, a bottom chord, and multiple diagonals. As FIG. 2 indicates, the top chord is a horizontal (or slightly sloped) member that in typical conditions fastens directly to the corrugated metal roof or floor deck that is being supported. The bottom chord is a horizontal member that is beneath and parallel (or nearly parallel) to the top chord. The diagonals (also known as web members) are inclined members arranged in a zig-zag pattern to join the top chord to the bottom chord. All of these members lie in, or nearly in, a common vertical plane.

The top chord of today's conventional steel joist consists of a pair of steel angles, parallel to one another, and positioned in a "back-to-back" orientation. See FIG. 3. The bottom chord also uses this same configuration. The web members are typically fabricated from steel angles or steel rods and are frequently welded in the gap between the parallel steel angles of the top (and bottom) chord.

Well known problems associated with present conventional steel joist constructions include: 1.) the need for erection bracing, also known as erection bridging as defined by OSHA; 2.) poor aesthetics; 3.) potential for corrosion of untreated areas; 4.) proclivity to top and/or bottom chord local bending; 5.) poor power actuated fastener penetration due to top chord local bending; 6.) inability to properly support/distribute and/or aesthetically conceal electrical and plumbing lines and HVAC ductwork. A need, therefore, exists for a steel joist assembly which resolves or greatly reduces these known problems.

SUMMARY OF THE INVENTION

The present invention is a substantially hollow tubular joist structure, a joist assembly including a plurality of aligned repetitive tubular joist structures, and a method of constructing this joist assembly. The tubular joists are preferably steel. Tubular joists offer several advantages over conventional steel joists. The tubular joists of the present disclosure are designed to fully comply with OSHA 29 C.F.R. §1926.757(a)(3), incorporated fully herein by reference.

Steel joists have never been fabricated exclusively from hollow steel tubes. These hollow steel tubes may include, by way of example and without limitation, a square, rectangular, round, oval, diamond shape, or hexagonal cross-section, however, it is understood that any suitable geometry could be employed as may be suitable for a particular application or known or developed by one of skill in the art. Preferred geometries may include round, square (including substantially square such as square with rounded or truncated corners), or rectangular (also perhaps with rounded or truncated corners) with rectangular or substantially rectangular being the most preferred cross-section. These hollow tubes (most preferably steel but may be constructed of any suitable material) shall be referred to herein as "tubular." Joists constructed using tubular chords which may also include tubular diagonals shall be referred to herein as "tubular joists".

The joist structure of the present disclosure includes a tubular top chord; a tubular bottom chord; and, a plurality of diagonals extending between the tubular top chord and the tubular bottom chord. The diagonals are also, in a preferred arrangement, tubular in construction. The diagonals are preferably arranged in a zig-zag formation between the tubular top chord and the tubular bottom chord.

The tubular top chord may be capable of receiving a power actuated fastener (PAF). The tubular top chord and the tubular bottom chord are capable of receiving a utility conduit. A utility conduit may include an electrical conduit or cable, a plumbing conduit, or it may receive a HVAC duct or may even itself act as an HVAC duct to convey conditioned air.

A method of constructing a tubular joist includes arranging a tubular top cord and a tubular bottom chord in a nearly or substantially parallel relationship. The tubular top chord and tubular bottom chord support one another through a plurality of diagonals which extend between the tubular top chord and tubular bottom chord in a preferred, substantially zig-zag manner. The diagonal are fastened to the tubular top chord and the tubular bottom chord preferably by welding or using fasteners or by any other means or as known in the art.

A method of constructing a tubular joist assembly of the present disclosure includes assembling a plurality of tubular joist structures each including a top chord, a bottom chord, and a plurality of diagonals extending between the top chord and bottom chord; and, wherein a plurality of the joist structures include a tubular top chord and a tubular bottom chord. This method of construction allows for the joist to be set in place with a substantially reduced requirement and in many instances without requiring a crane to support the joist while the erection bridging is installed since in most practical cases the erection bracing can be eliminated. By way of example, however, a tubular joist structure, as disclosed herein, could also be fabricated so as to be longer than conventional joists. In such longer structures, it is contemplated that erection bracing or the use of a crane for support during installation of the erection bracing may be preferred.

BRIEF DESCRIPTION OF THE DRAWINGS

FIG. 6A is a partial side view of a tubular joist assembly of the present disclosure requiring less bracing due to the fact that tubular constructed bottom chords can support heavier local loads.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 3A:
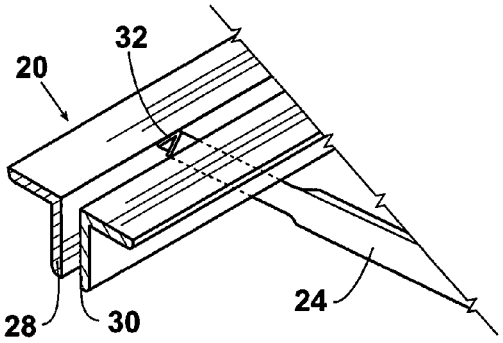
Fig. 3A ( PRIOR ART )
FIG. 3A depicts a conventional steel top chord construction.
Figure 3B:
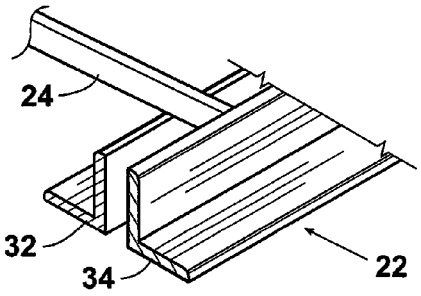
Fig. 3B ( PRIOR ART )
FIG. 3B depicts a conventional steel bottom chord construction.
Figure 2:
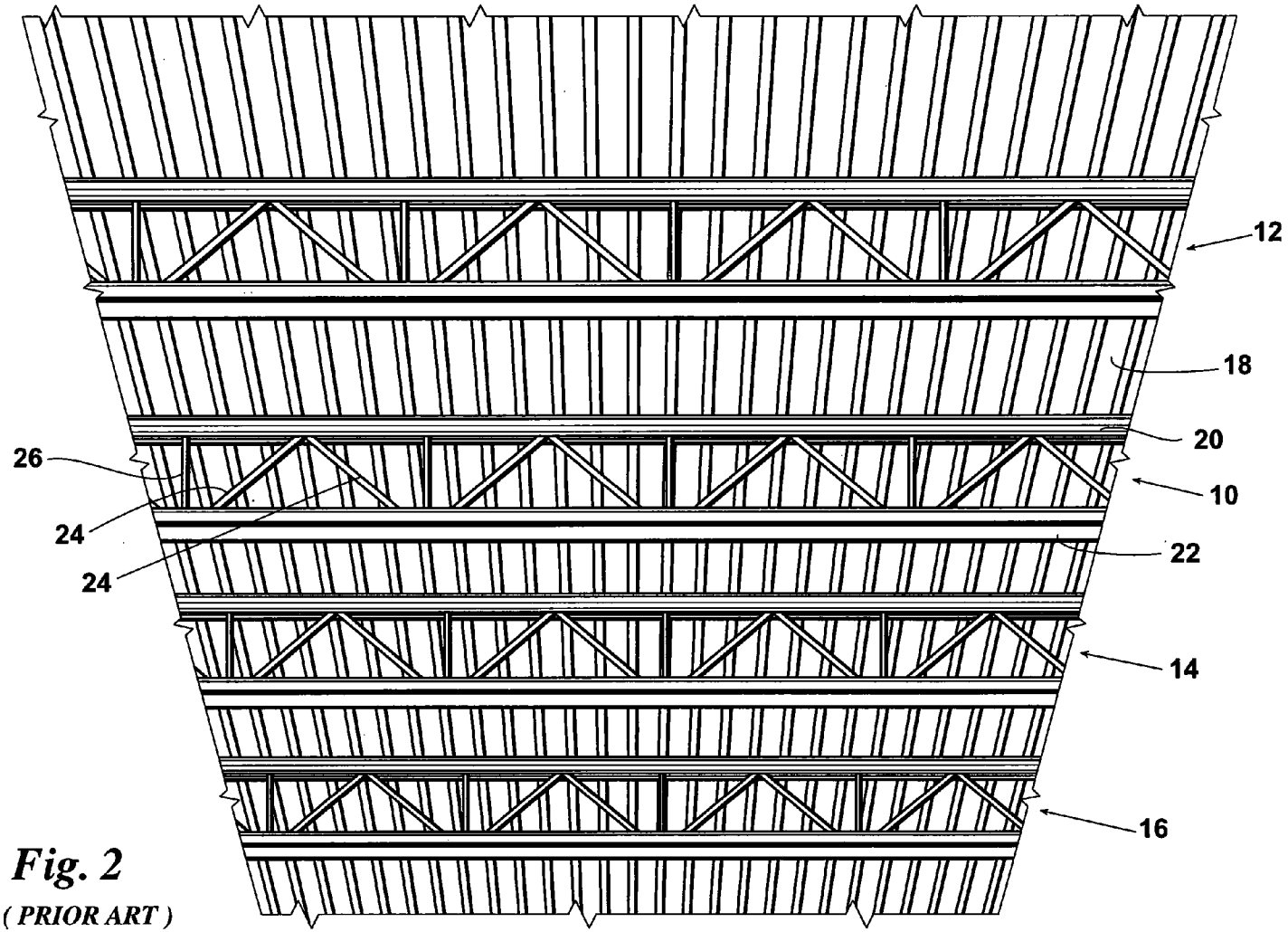
Fig. 2 ( PRIOR ART )
FIG. 2 depicts a prior art joist top chord, joist bottom chord, and joist diagonals.

With reference to FIG. 2 in combination with FIGS. 3A and 3B, a conventional steel joist 10 generally includes a top chord 20, a bottom chord 22 and multiple diagonals 24. A plurality of joists 12, 14, and 16 identical to joist 10 are depicted in FIG. 2 supporting a corrugated metal roof deck 18. Top chord 20 is a horizontal (or slightly sloped) member that in typical conditions fastens directly to corrugated metal roof 18 or to a floor deck in an alternate application. FIG. 3A depicts top chord 20 which includes two opposed steel angles 28 and 30. Diagonal 24 extends between steel angles 28 and 30. Diagonal 24 is depicted to include a crimped end 32 which is sandwiched and welded between opposed angles 28 and 30.

Bottom chord 22 is a horizontal member that is beneath and parallel (or nearly parallel) to top chord 20. With reference to FIG. 3B, bottom chord 22 is depicted. Bottom chord 22 is comprised commonly of up to two steel angles 32 and 34. Diagonal 24, as with top chord 20, frequently includes a crimped end which is sandwiched between steel angles 32 and 34 and typically welded therein.

The diagonals 24 (FIG. 2) are also commonly referred to as web members and are inclined members arranged in a zig-zag pattern to join top chord 20 to bottom chord 22. The diagonal members 24 are typically fabricated from steel angles or steel rods and welded between the steel angles of the top chord 20 and the bottom chord 22. Top chord 20, diagonals, collectively 24, and bottom chord 22 are typically configured to be in a common vertical plane.

Figure 1:
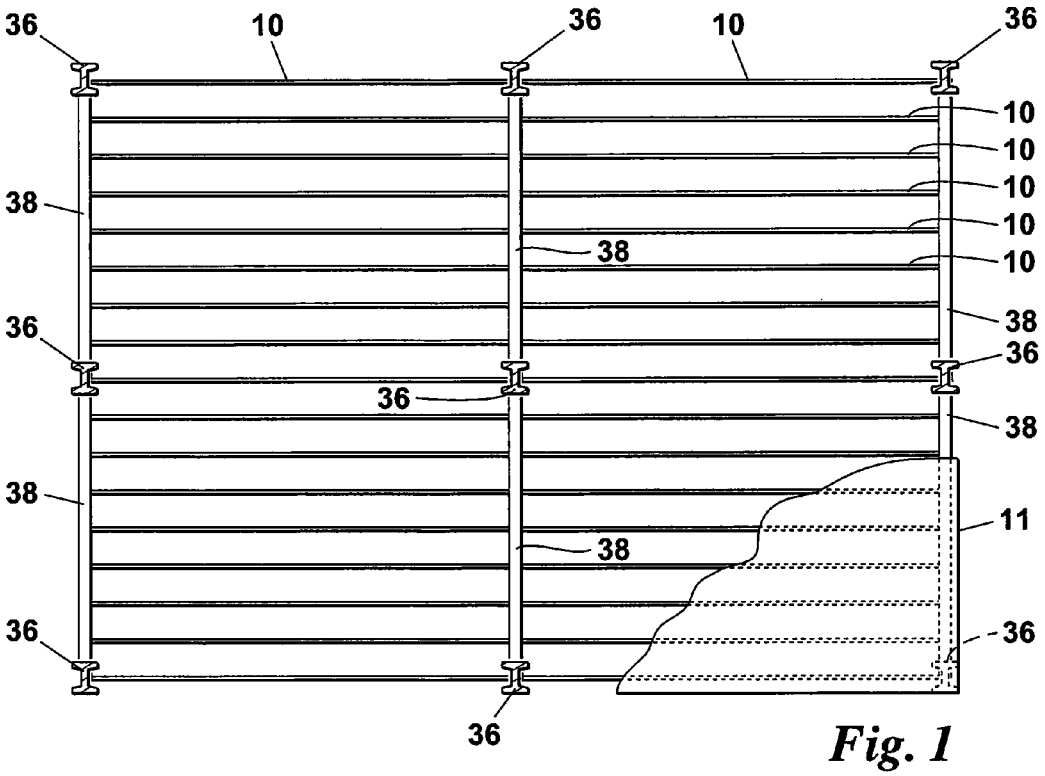
Fig. 1 ( PRIOR ART )
FIG. 1 depicts a typical prior art floor or roof plan view showing joists, girders, and columns.

FIG. 1 depicts a conventional array of conventional open-web joists 10 forming a support for a deck or roof 11 shown partially cut-away. Vertical building columns 36 support a plurality of girders 38. Girders 38, in turn, support joists 10. In the exemplary array depicted in FIG. 1, nine building columns 36 support six girders 38 to which thirty-four joists 10 are secured.

Figures 10, 11, 12:
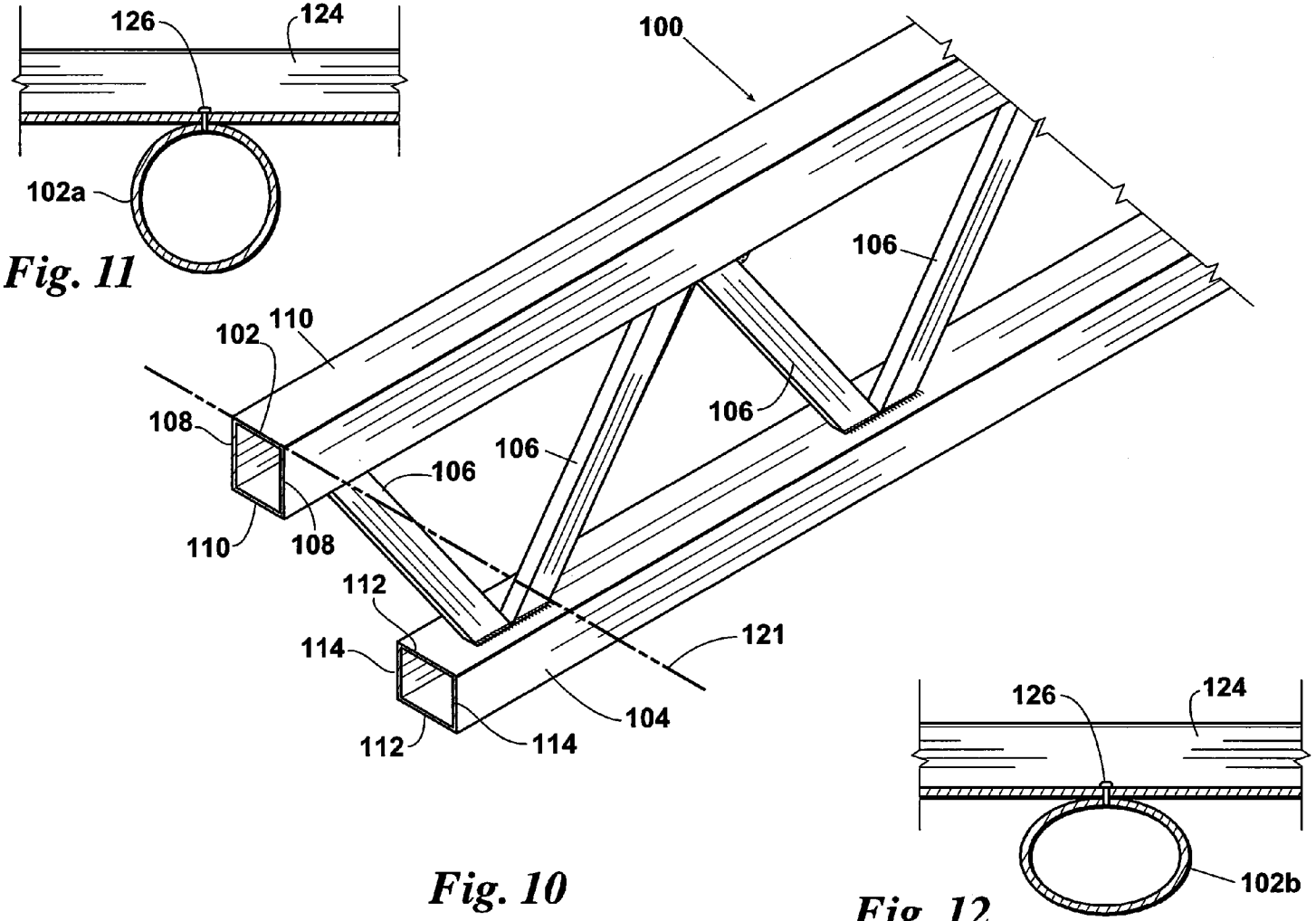
FIG. 10 depicts an isometric view of a tubular joist assembly of the present disclosure.
FIG. 11 depicts a partially cut away view of a tubular joist assembly of the present disclosure depicting a substantially round cross-section.
FIG. 12 depicts a partially cut away view of a tubular joist assembly of the present disclosure depicting a substantially oval cross-section

FIG. 10 depicts a tubular joist construction of the present invention which is contemplated to replace joists 10 in applications such as depicted in FIG. 1. With reference to FIG. 10, tubular joist 100 includes a tubular top chord 102 and a tubular bottom chord 104 connected by diagonals 106. In the preferred embodiment depicted in FIG. 10, top chord 102 includes a length of tubular steel, preferably high strength (HSS) with a substantially rectangular cross section. In this embodiment top chord 102 is oriented such that the longer sides 108 of the rectangular cross section are oriented substantially vertically while the shorter sides 110 are oriented substantially horizontally.

Bottom chord 104 includes a length of tubular steel the same construction as top chord 102 and positioned parallel to top chord 102 and separated by diagonals 106. In the preferred arrangement depicted in FIG. 10, bottom chord 104 includes substantially the same rectangular geometry in cross section as is top chord 102. However, in this embodiment, the longer sides of the rectangular cross section 112 are positioned horizontally while the shorter sides 114 are positioned vertically. It should be understood that the embodiment depicted in FIG. 10 is exemplary such that tubular top chord 102 and tubular bottom chord 104 could have the same or different cross sectional geometries or orientations from one another or could be oriented in any desired manner. Alternatively, it is conceivable that top chord 102 could be replaced with a conventional top chord design, such as 20 of FIG. 3A such that only bottom chord 104 is tubular. Likewise bottom chord 104 could alternatively be replaced with a conventional bottom chord design, such as 22 of FIG. 3B such that only top chord 102 is tubular.

Diagonals 106 connect tubular top chord 102 and tubular bottom chord 104. In the preferred arrangement, diagonals 106 are also steel tubular construction also with a rectangular cross section but of a smaller size than tubular top chord 102 and tubular bottom chord 104. However, it is understood that diagonals 106 could be constructed of any suitable geometry. Alternatively, diagonals 106 could be of a conventional construction and not tubular. Diagonals 106 in the preferred arrangement are oriented in a zig-zag pattern to join tubular top chord 102 and tubular bottom chord 104. Diagonals 106 are welded to top chord 102 and bottom chord 104, thus forming a rigid open web tubular joist design. Tubular top chord 102, tubular bottom chord 104 and diagonals 106, when constructed lie in, or nearly in, a common vertical plane.

Tubular joists offer several advantages over conventional steel joists. Specifically, nine such advantages have been identified and are set forth herein. For example, with regard to fabrication, tubular joists have several advantages. Tubular joists have half the number of chord pieces, and one-third fewer web member pieces (no verticals) to handle and cut in the shop. Tubular joists will have less than half the surface area that must be coated. All web-to-chord tubular connections are simple gapped joints with small fillet welds made on the flat area of the HSS tube wall.

Figure 4A:
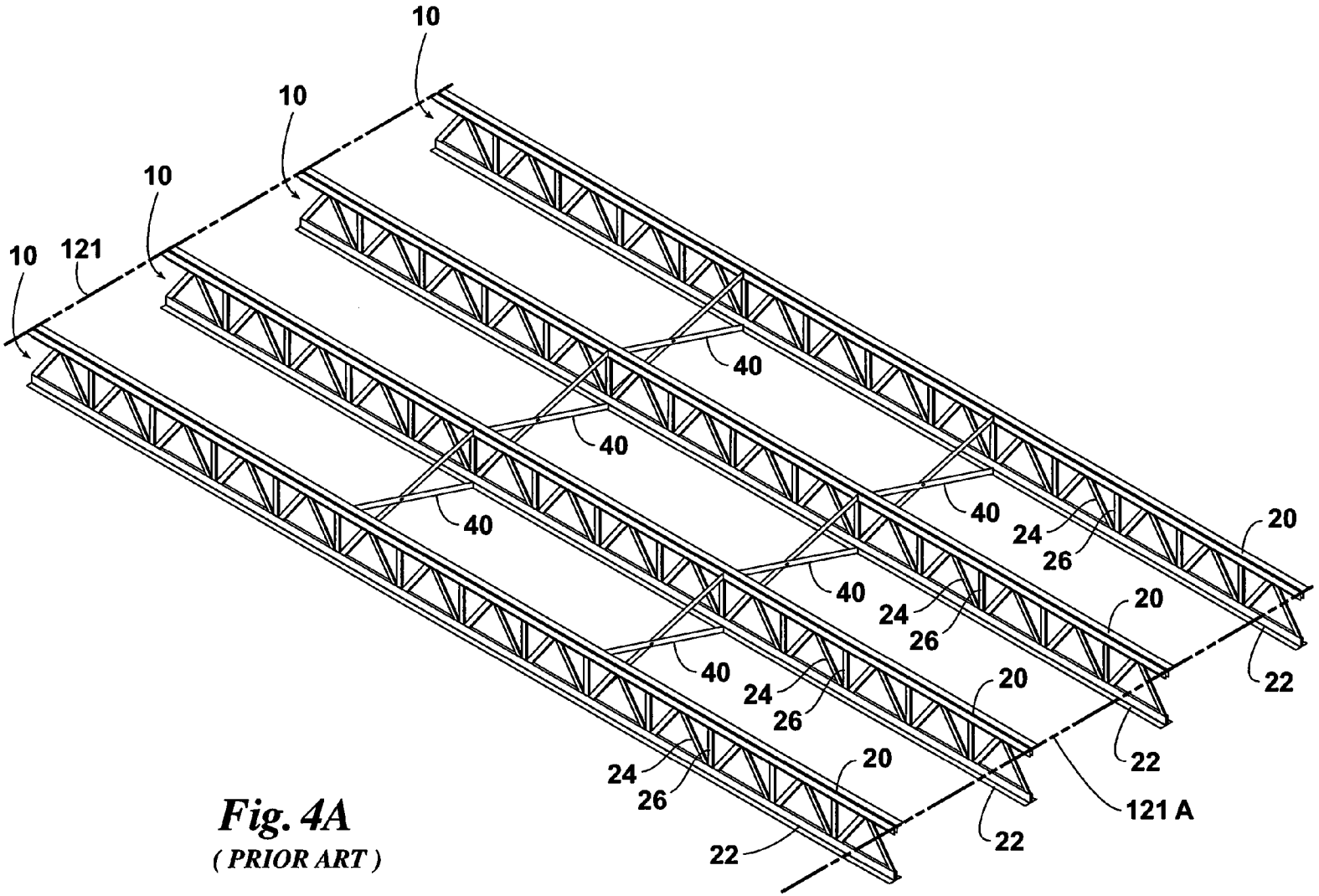
Fig. 4A ( PRIOR ART )
FIG. 4A is a perspective view of a prior art joist assembly requiring erection bracing.

Advantage 1: Erection Bracing:

With reference to FIG. 4A, conventional joist chords 20, 22, consisting of a pair of steel angles, offer relatively little resistance against torsion (i.e., twist). The chord's resistance to torsion, or lack thereof, heavily influences a joist's tendency to laterally buckle under the weight of an iron worker. Consequently, since conventional joists 10 lack torsional resistance they are prone to lateral buckling. As a result, the United States Occupational, Health, and Safety Administration (OSHA) has strict rules, for joists exceeding certain lengths, that require the crane lifting assembly (e,g., the crane hook) to remain connected to the joist until after "erection bridging" is installed. "Erection bridging" 40 typically consists of bracing members that laterally support the joist 10 and prevent lateral buckling under the weight of an iron worker. It is typically provided in a "X" brace configuration (FIG. 4A). As elaborated below, a comparable tubular joist offers superior torsional resistance, leading to greater stability against lateral buckling.

The torsional constant "J", which is a property of the member cross section, directly impacts the member's effectiveness in resisting torsion: the greater "J", the greater the resistance against torsion. The following comparison contrasts a conventional top chord 20 (FIG. 3A) consisting of ¼ " thick angles with 4" long legs and a ¾" gap between the angles, and a comparable tubular chord:

Conventional chord 20, J=0.088 $in^4$.

A Square tubular chord 118 (FIG. 4B) of the present disclosure, having equivalent weight (4" square, 0.2586" thick): J=13.54 $in^4$.

Figure 4B:
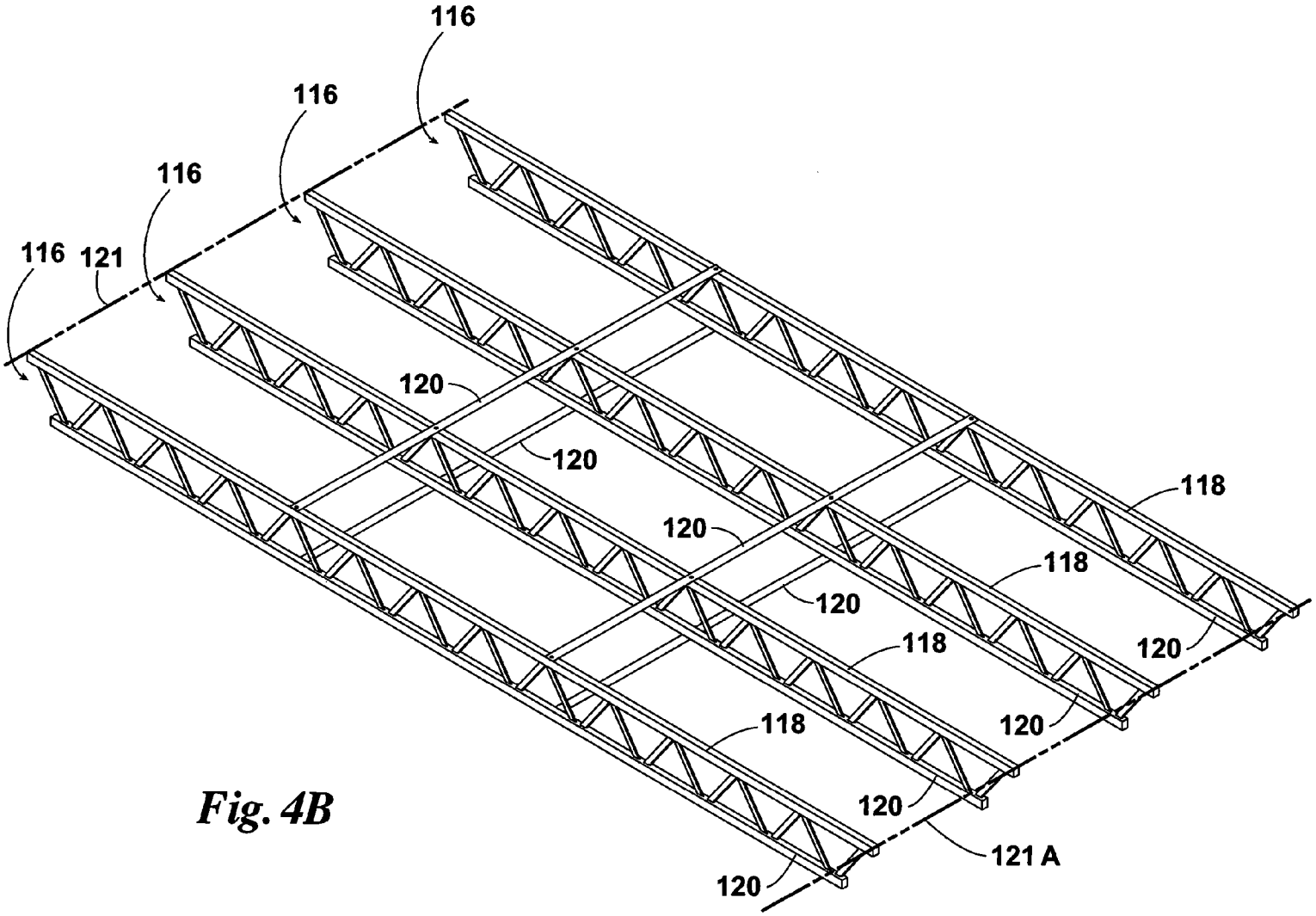
FIG. 4B is a perspective view of the tubular joist assembly of the present disclosure requiring only horizontal bracing.

Hence, the tubular chord 118 (FIG. 4B) offers a torsional constant that is 150 times greater than the conventional joist chord 10. The same would be true for a comparison of a conventional bottom chord 22 (FIG. 4A) and a square tubular chord 120 (FIG. 4B). The efficiency offered by tubular joist 118 dramatically reduces the joist's tendency to buckle and can reduce, and in most cases, eliminate the need for erection bridging (40 of FIG. 4A). This allows the erection bridging to be replaced by simple horizontal bridging 120 (FIG. 4B) that is installed after the crane has released from joist 116. The assembly benefits are two-fold:

workers will be supported by more stable joists, and the erection bridging (bolted X bridging) installation operation will be reduced or eliminated.

According to the erection stability equation that is behind the OSHA erection bridging span tables, an unbraced conventional design (32LH06) joist performs unfavorably compared to an unbraced tubular joist of the present disclosure of equivalent weight & load carrying capacity:

| | Conventional Joist | Tubular Joist |
|---|---|---|
| Allowable span without erection bridging | 40 feet | 90 feet |
| Weight of erector that causes a 40' span to buckle | 100 lbs | 3300 lbs |

This is because the torsional constant of the tubular joist is 130 times greater than that of the conventional joist. As a result, the tubular joist design of the present disclosure would be the first joist to be manufactured in compliance with OSHA 29 C.F.R. §1926.757(a)(3).

The cost benefits are also two-fold:

crane rental cost savings will accrue from the additional speed of erection that comes from avoiding the delay caused by the crane holding the joist while erection bridging is installed, and Example Crane Savings from Eliminating Bolted X Bridging (BXB):

$$330 \text{ joists} * \frac{2\ BXB \text{ sets}}{\text{joist}} * \frac{3.7 \text{ min of crane time per set}}{60 \text{ min per } hr} = 40.6 \text{ crane hours}$$

$$40.6 \text{ crane hours} * \frac{\$285}{\text{crane hour}} = \$11{,}568$$

reducing/eliminating the erection bridging will reduce the number of bracing members that must be installed. The example in FIG. 4B shows replacing the erection bridging 40 (FIG. 4A) with horizontal bridging 120 (FIG. 4B) affords the following quantity reductions:

the number of bracing members is reduced by a factor of 3, and the number of bolts is cut in half.

Example Labor Savings Form a Typical 150,000 sq. Ft. Building Replacing Bolted X Bridging (BXB) with Horizontal Bridging $$1680 \text{ sets of } BXB * 2 \text{ men} * \left(\frac{6 \text{ min saved per set}}{60 \text{ min per } hr}\right) = 336\ manhours$$

$$336\ manhours * \$46.31 \text{ per } hr = \$15{,}562$$

Advantage 2: Aesthetics:

Conventional steel joists 10 (FIG. 4A) are typically used in areas where aesthetic considerations are secondary. Architecturally, tubular steel joists 116 (FIG. 4B) would usually be preferred over conventional steel joists. Readily available tubular steel joists would increase the market available for steel joist construction.

Advantage 3: Corrosion Reduction:

Conventional steel joist fabrication utilizing a pair 28, 30 and 32, 34 (FIGS. 3A and 3B) of steel angles for each chord 20, 22 results in tight spaces where it is very difficult to adequately weld, leading to rough welds creating water traps. Experience has shown that this difficulty leads to localized areas that are susceptible to corrosion. Consequently, engineers generally do not use conventional steel joists if those joists will be exposed to outside air or otherwise corrosive environments. A tubular joist 100 (FIG. 10) avoids this since all exposed surfaces are accessible to welding and painting. Hence, this attribute of the tubular joist would further increase the market available for steel joist construction.

Figure 5A:
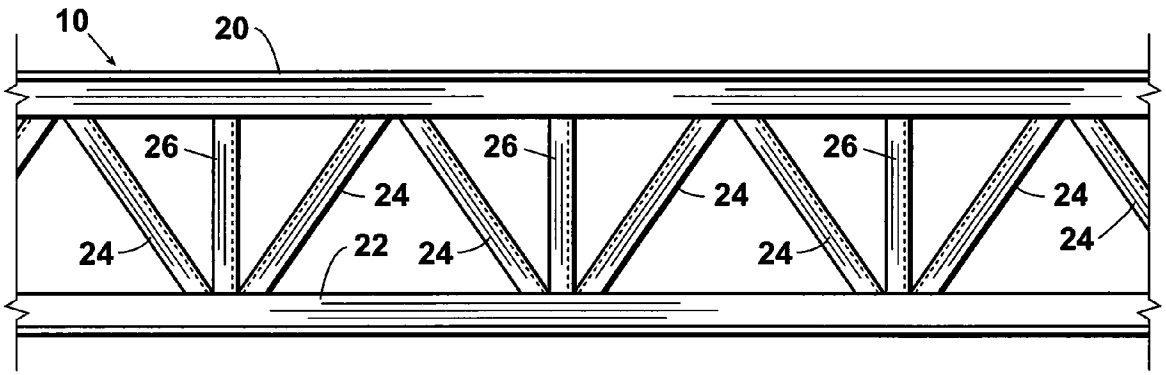
Fig. 5A ( PRIOR ART )
FIG. 5A is a partial side view of a conventional steel joist construction illustrating the need for vertical web members to locally support the top chord to reduce bending stresses.
Figure 5B:
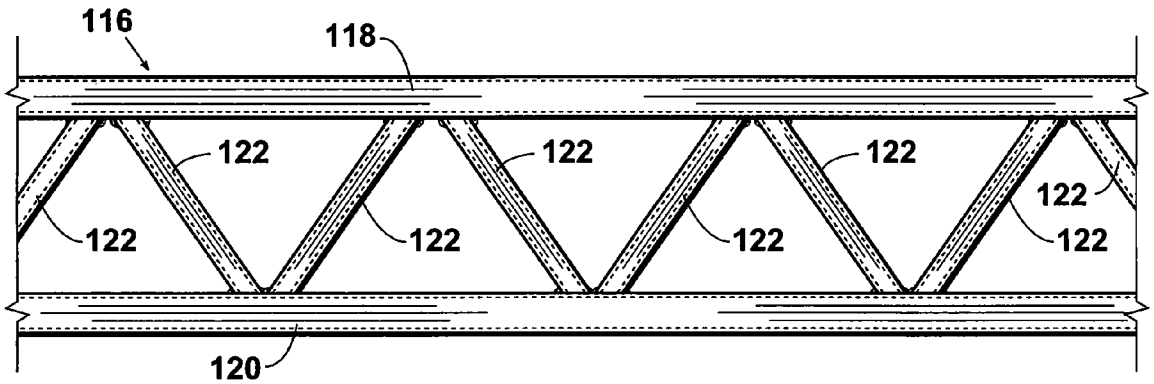
FIG. 5B is a partial side view of a tubular joist assembly of the present disclosure which illustrates the benefits of the top chord local bending strength that allows vertical web members to be eliminated.

Advantage 4: Top Chord Local Bending:

With reference to FIGS. 5A and 5B, the top chord of a tubular joist 116 (FIG. 5B) offers greater strength against local bending than that of a comparable conventional joist 10 (FIG. 5B). The section modulus is a property of the member cross section that is a direct measure of the allowable weight a member can support. If the section modulus is doubled, the allowable supported weight is doubled. Using the same comparison as was done for the torsional constant:

Conventional chord 20 (FIG. 5A), S=2.06 $in^3$

Tubular chord 118 (FIG. 5B) of equivalent weight (4" square, 0.2586" thick); S=2.5 $in^3$.

Hence, an equivalent square tubular chord 118 offers a 21% increase in bending strength over the conventional chord 20. This efficiency offers two cost benefits:

Uniformly distributed roof/floor loading on the top chord 20 of a conventional joist 10 is typically carried by adding a vertical web member 26 to the joist during fabrication (FIG. 5A). This provides support to the otherwise unsupported top chord 20 between the panel points where diagonals 24 attach to chords 20 and 22. The tubular joist 116 (FIG. 5B), since it is stronger in bending avoids this, resulting in fewer web members, Concentrated floor or roof loads often fall on the joist top chord between the panel points. Roof top HVAC units are an example of this. Such conditions will typically require a supplemental reinforcing member to be installed, usually in the field, to support the top chord beneath the concentrated load, A tubular top chord will reduce the number of instances where this reinforcement is required.

Figure 6A:
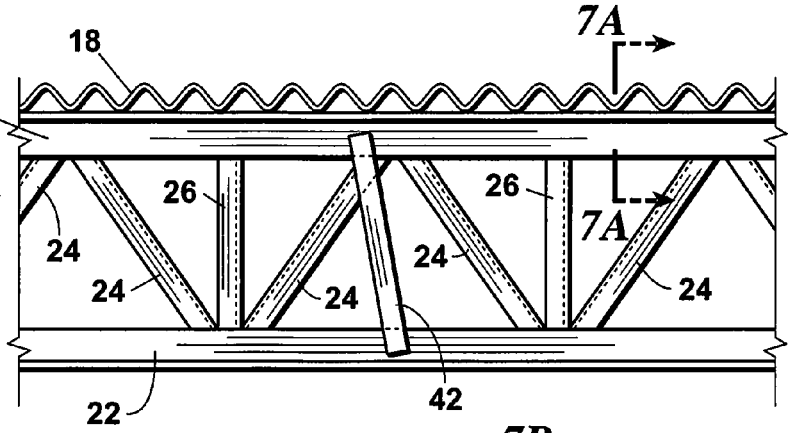
Fig. 6A ( PRIOR ART )
FIG. 6A is a partial side view of a conventional steel joist construction assembly illustrating the need for additional bracing against bottom chord local bending.
Figure 6B:
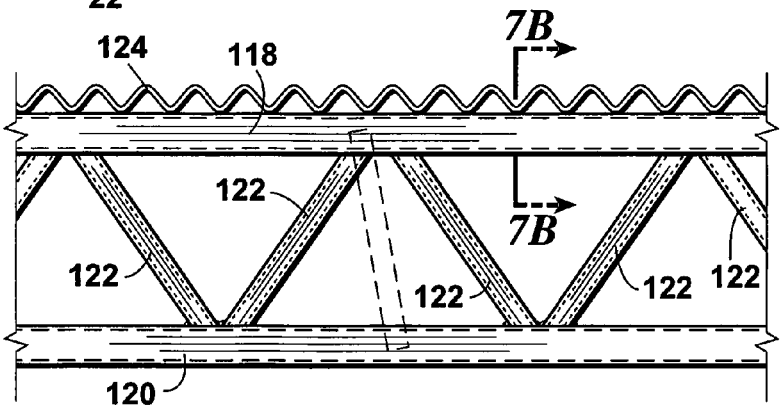

Advantage 5: Bottom Chord Local Bending:

With reference to FIGS. 6A and 6B, with regard to a conventional steel joist, concentrated hanger loads often fall on the joist bottom chord 22 between the panel points where the diagonals 24 attach to bottom chord 22. HVAC ductwork is an example of this. Such conditions will typically require a reinforcing member 42 to be installed to support the otherwise unsupported length of bottom chord 22 between diagonals 24' and 24' (FIG. 6A) because double angle chords are relatively weak in regard to their ability to withstand bending stresses/forces.

Similar to the top chord comparison, the additional bending strength of an equivalent tubular bottom chord 120 (FIG. 6B) reduces the number of instances where this reinforcing member is (shown in phantom) needed between diagonals 122.

Figure 7A:
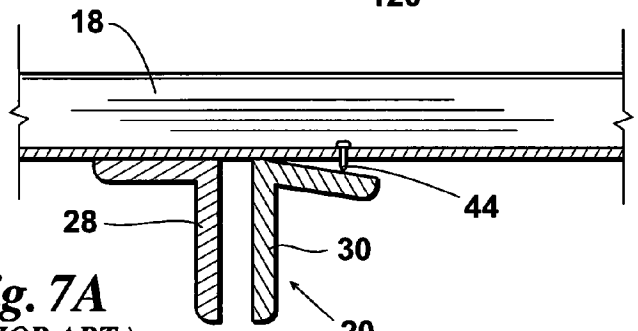
Fig. 7A ( PRIOR ART )
FIG. 7A depicts a partially cut away view, taken along line 7A-7A of FIG. 6A of a conventional steel joist construction illustrating a common problem associated with failure of a power actuated fastener (PAF) to penetrate the top chord of the joist causing local top chord bending.
Figure 7B:
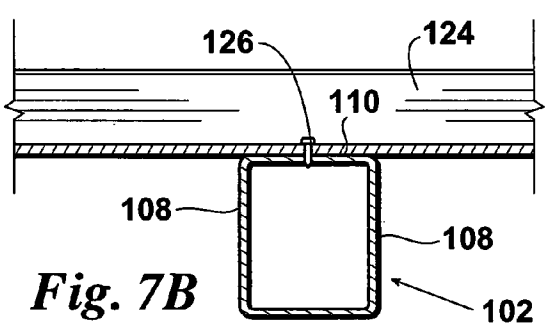
FIG. 7B depicts a partially cut away view, taken along line 7B-7B of FIG. 6B, of a tubular joist assembly of the present disclosure receiving an exemplary power actuated fastener.

Advantage 6: Local Bending Preventing PAF Penetration:

Attention is next directed to FIGS. 7A and 7B. First with reference to FIG. 7A a conventional joist construction, power actuated fasteners (PAF) 44 are a relatively new addition to the various alternatives for fastening a corrugated metal deck 18 to the top chord 20 of a joist. PAF's are a fast and often preferred means of attaching the corrugated metal deck 18 to the supporting joists. Conventional joists have been known to bend locally as shown in FIG. 7A, preventing the PAF 44 from penetrating steel angle 30 of steel top chord 20. Because of this, engineers sometimes prohibit the use of PAF's on projects.

Referring to FIG. 7B, since the top face 110 of tubular chord 102 is supported by both sidewalls 108 of the tube, a tubular chord would likely eliminate this problem, opening the door to the cost savings that comes with the speed of construction associated with PAF's. Re-work costs related to this problem would also be avoided, and the risk of a poorly fastened metal deck would be reduced. This latter benefit is also a structural stability benefit since buildings frequently depend on the corrugated metal deck for overall building stability, and proper fastening of the deck is critical to that function.

Figure 8A:
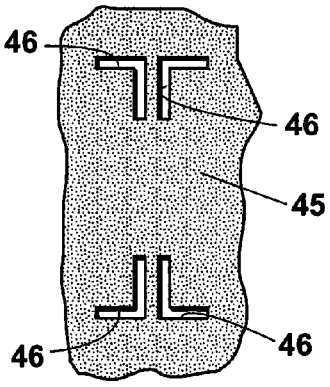
Fig. 8A ( PRIOR ART )
FIG. 8A depicts exemplary wall penetrations of the top chord and bottom chord of a conventional steel joist construction assembly.
Figure 8B:
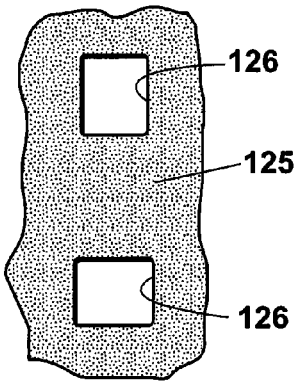
FIG. 8B depicts exemplary wall penetrations of the top chord and bottom chord of a tubular joist chord assembly of the present disclosure.

Advantage 7; Wall Penetrations:

Reference is next made to FIGS. 8A and 8B. When joist chords or diagonals in a conventional joist design (FIG. 8A) must pass through a wall 45, "L" shaped wall cutouts 46 shown in FIG. 8A are often made to accommodate the wall penetration. These cutouts 46 are expensive relative to the cutouts 126 in wall 125 required for a tubular member as depicted in FIG. 8B. Simplifying these cutouts will result in construction labor cost savings.

Figure 9:
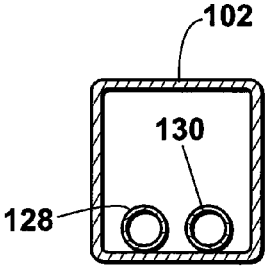
FIG. 9 depicts exemplary electrical and plumbing lines inside a tubular joist chord of the present disclosure.

Advantage 8: Electrical and Plumbing Lines:

When electrical and plumbing lines run parallel to the conventional joists that support them, clips and hangers must be used to attach those lines to the joist chord(s). A tubular joist chord provides a ready conduit for these lines 128, 130 (FIG. 9), and in a large building it would eliminate significant quantities of clips and hangers resulting in labor and material cost savings. Such an arrangement also provides the aesthetic benefit of concealing lines 128 and 130.

Advantage 9: Conditioned Air Delivery

Similar to electrical and plumbing lines 128 and 130 (FIG. 9), HVAC ductwork often runs parallel to the joists supporting it. In such cases, the tubular chord 102 is available for distributing air and if utilized, may substantially reduce the quantity of ductwork needed for the building. Again, this would lead to construction labor and material cost savings, and the aesthetic benefit of less visible ductwork.

An example calculation of estimated cost savings for the different one-story "Big Box" type buildings resulting from the use of the tubular steel joists of the present disclosure over a conventional steel joists are set forth in Table I.

TABLE I

One Story "Big Box" Type Bldg
Cost Benefit From Using Tubular LH Joists
Metal Deck Roof: 1.5B. 22 GA with 5⅝" Puddle Welds & 8 -#10 TEK Sidelap Screws

| Measure | Joists Spanning 60' | Joists Spanning 75' | Joists Spanning 90' |
|---|---|---|---|
| Building Site | 153,600 SF | 157,500 SF | 162,000 SF |
| Tonnage | 310 tons (181 tons of joists) | 434 tons (260 tons of joists) | 525 total tons (322 tons of joists) |
| Schedule Reduction (days) | 26 days reduced to 20 ==> 6 days | 44 days reduced to 38 ==> 6 days | 45 days reduced to 39 ==> 6 days |

TABLE I-continued

One Story "Big Box" Type Bldg
Cost Benefit From Using Tubular LH Joists
Metal Deck Roof: 1.5B. 22 GA with 5⅝" Puddle Welds & 8 -#10 TEK Sidelap Screws

| Measure | Joists Spanning 60' | Joists Spanning 75' | Joists Spanning 90' |
|---|---|---|---|
| Field Savings ($) | $50,015 | $48,989 | $47,979 |
| Add'l Mat'l Cost of HSS ($) | $24,678 | $29,122 | $34,223 |
| Net Benefit ($) | $25,337 | $19,867 | $13,756 |
| Net Benefit ($/lb of joists) | $0.07 | $0.04 | $0.02 |

Notes:
1) Field savings reflect steel erection bid prices based on generally accepted labor productivity rates as compiled by the software program "Steel Erection Bid Wizard", This program has been the subject of a Steel Erectors Association of America (SEAA) newsletter, and is used by Granau Metals, Panther City Ironworks, WhaleySteel, Harris County Ironworks, and 71 other domestic Steel Erectors for producing steel erection bids.
2) Material costs assume $40.00/cwt for rolled angle iron and $50.43/cwt for HSS tubing.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A joist structure having a span for spanning between a first support and a second support and having a center of gravity, said joist structure comprising:

a singular tubular top chord having a continuously closed, non-adjustable length;

a singular tubular bottom chord having a continuously closed, non-adjustable length;

a plurality of discrete diagonal segments each welded to and extending between said tubular top chord and said tubular bottom chord such that said top chord is spaced from said bottom chord by said plurality of discrete diagonal segments;

said top chord, said diagonal segments, and said bottom chord together forming a height of the joist structure said joist structure spanning and configured to be secured to the first support and the second support at points that are higher than the center of gravity of the joist structure;

said length of said top chord and said length of said bottom chord together with said plurality of diagonal segments forming a secondary structural member which is dimensioned to support at least 250 pounds located anywhere along the joist without requiring any erection bracing or bridging for a span of at least 24 times the height of the joist structure.

2. The joist structure of claim 1 wherein at least one of said plurality of said diagonals is tubular.

3. The joist structure of claim 1 wherein substantially all of said plurality of said diagonals are tubular.

4. The joist structure of claim 3 wherein said plurality of diagonals are arranged in a zig-zag formation between said tubular top chord and said tubular bottom chord.

5. The joist structure of claim 1 wherein said tubular top chord has a cross-section and said tubular bottom chord has a cross-section such that at least one of said cross section of said tubular top chord and said cross-section of said tubular bottom chord are substantially square.

6. The joist structure of claim 1 wherein said tubular top chord has a cross-section and said tubular bottom chord has a cross-section such that at least one of said cross-section of said tubular top chord and said cross-section of said tubular bottom chord are substantially rectangular.

7. The joist structure of claim 1 wherein said tubular top chord has a cross-section and said tubular bottom chord has a cross-section such that at least one of said cross-section of said tubular top chord and said cross-section of said tubular bottom chord are substantially round.

8. The joist structure of claim 1 wherein said tubular top chord has a cross-section and said tubular bottom chord has a cross-section such that at least one of said cross-section of said tubular top chord and said cross-section of said tubular bottom chord are substantially oval.

9. A plurality of joist structures of claim 1 aligned substantially parallel to form an assembly capable of supporting a structural element.

10. The joist structure of claim 1 wherein said tubular top chord is capable of receiving a power actuated fastener.

11. The joist structure of claim 1 wherein said tubular top chord or said tubular bottom chord are capable of receiving a utility conduit.

12. A method of constructing a joist structure capable of supporting a structural element, comprising:

assembling a joist structure including a singular top chord and a singular bottom chord, by welding a plurality of tubular diagonal segments between said top chord and said bottom chord to form a secondary structural member;

said plurality of tubular diagonal segments each including a first open end and a second open end wherein said first open end is welded to said top chord and said second open end is welded to said bottom chord said joist structure including a continuously closed tubular top chord having a cross-section of constant outside perimeter length and shape and a continuously closed tubular bottom chord having a cross-section of constant outside perimeter length and shape; and a length of said top chord and a length of said bottom chord together with said plurality of diagonal segments forms the secondary structural member which is dimensioned to support at least 250 pounds located anywhere along the joist without requiring any erection bracing or bridging for a span of at least 24 times a height of the joist structure.

13. The joist structure of claim 12 wherein substantially all of said plurality of said diagonals are tubular.

14. A structural element including a plurality of joist assemblies, comprising:

a plurality of non-composite joist structures each including a singular top chord having a cross-section of constant outside perimeter length and shape and a non-adjustable length, a singular bottom chord having a cross-section of constant outside perimeter length and shape and a non-adjustable length, and a plurality of tubular diagonals extending between said top chord and said bottom chord;

said plurality of diagonal each including a first open end and a second open end wherein said first open end is welded to said top chord and said second open end is welded to said bottom chord; and a length of each of said top chord and a length of each of said bottom chord together with said plurality of diagonals forming a secondary structural member which is dimensioned to support at least 250 pounds located anywhere along the joist structures without requiring any erection bracing or bridging for a span of at least 24 times a height of the joist structures.

15. The joist assembly of claim 14 wherein said plurality of joist structures are aligned substantially parallel such that the assembly is capable of supporting a structural element.

16. The joist structure of claim 14 wherein substantially all of said plurality of said diagonals are tubular.

17. The joist structure of claim 15 wherein substantially all of said joist structures include a tubular top chord and a tubular bottom chord.

18. A method of constructing a plurality of joist structures capable of supporting a structural element wherein each of the plurality of joist structures having a span for spanning between a first support and a second support and having a center of gravity, the method comprising:

the plurality of joist structures each comprising a top chord and a bottom chord each having a material thickness and a non-adjustable length;

determining an optimum material thickness of said top chord and said bottom chord based upon said non-adjustable length and the weight from the structural element;

said length of said top chord and said length of said bottom chord together with said plurality of diagonal segments forming a secondary structural member;

assembling each said joist structure such that said top chord is spaced from said bottom chord by said plurality of diagonals;

securing each said joist structure to the first support and the second support at points that are higher than the center of gravity of the joist structure;

assembling a plurality of said joist structures without erection bracing for the joist structure of said plurality of joist structures including a tubular top chord, a tubular bottom chord, and a plurality of diagonals extending between said top chord and said bottom chord.

19. An improved joist structure which has a center of gravity, a self-weight, and a span which spans supports at each end and functions as a secondary structural member that, in the final constructed condition, fastens directly to and directly supports a roof or floor deck, concrete floor, or flat structural element the improvement comprising:

a singular tubular top chord having a cross-section of constant outside perimeter length and shape;

said top chord including a continuously closed, non-adjustable length;

a singular tubular bottom chord having a cross-section of constant outside perimeter length and shape;

said bottom chord including a continuously closed, non-adjustable length;

a plurality of discrete diagonal segments each welded to and extending between said tubular top chord and said tubular bottom chord, said top chord being spaced from said bottom chord by said plurality of discrete diagonal segments;

said top chord, said diagonal segments and said bottom chord together forming a height of the joist structure;

dimensioned to provide strength sufficient to support 250 lb of weight, in addition to the joist structure self-weight, positioned anywhere along the top chord of the joist structure without requiring any erection bracing or bridging along the span to prevent structural instability for spans of at least 24 times the height of the joist structure.

* * * * *